US008448811B2

(12) United States Patent
Gross et al.

(10) Patent No.: US 8,448,811 B2
(45) Date of Patent: May 28, 2013

(54) PREPARATION TRAY

(76) Inventors: Mark Gross, Downey, CA (US); Brett Gross, Tarzana, CA (US); Eric Gross, Los Angeles, CA (US)

( * ) Notice: Subject to any disclaimer, the term of this patent is extended or adjusted under 35 U.S.C. 154(b) by 189 days.

(21) Appl. No.: 12/928,895

(22) Filed: Dec. 21, 2010

(65) Prior Publication Data

US 2012/0152797 A1 Jun. 21, 2012

(51) Int. Cl.
*B65D 1/34* (2006.01)

(52) U.S. Cl.
USPC ..... 220/605; 220/608; 220/572; 206/557

(58) Field of Classification Search
USPC ..... 220/571, 572, 574, 608, 605; 206/557
See application file for complete search history.

(56) References Cited

U.S. PATENT DOCUMENTS

D276,026 S * 10/1984 Hexamer ..... D9/425
2007/0228052 A1 * 10/2007 Hayes et al. ..... 220/608

* cited by examiner

*Primary Examiner* — Stephen Castellano
(74) *Attorney, Agent, or Firm* — James E. Brunton

(57) ABSTRACT

A durable preparation tray for preparing and serving food items. The preparation tray, which is constructed from a microwaveable plastic material, includes a bottom wall provided with an upstanding food support structure, a catch basin for catching liquids associated with the food and a pour channel for pouring liquid from the catch basin.

4 Claims, 2 Drawing Sheets

PREPARATION TRAY

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to utensils for preparing and serving food items. More particularly, the invention concerns a novel preparation tray and preparation tray assembly for preparing and serving food items.

DISCUSSION OF RELATED ART INCLUDING INFORMATION DISCLOSED UNDER 37 CFR 1.97 AND 1.98

A wide variety of different types of food preparation trays have been suggested in the past. Typically, these food preparation trays are of a simple, pressed paper construction and are generally discarded after a single use. Exemplary of such prior art trays are the trays manufactured by the Huhtamaki Company of Desoto, Kans.

BRIEF SUMMARY OF THE INVENTION

By way of brief summary, one form of the preparation tray of the present invention includes a bottom wall having a top surface and a bottom surface; first and second transversely spaced apart side walls connected to the bottom wall and extending angularly upwardly there from; first and second longitudinally spaced apart end walls connected to the bottom wall and extending angularly upwardly there from; a first angularly upwardly extending pour channel formed between the first sidewall and the first end wall; a second angularly upwardly extending pour channel formed between the second sidewall and the second end wall; and a food support structure connected to and extending upwardly from the top surface of the bottom wall for supporting food articles within the preparation tray.

The foregoing in mind, it is an object of the present invention to provide a food preparation tray of the foregoing character that is formed from a smooth, non-porous, rigid material which can be easily cleaned and reused.

Another object of the invention is to provide a fluid preparation tray of the character described that is microwavable.

Another object of the invention is to provide a fluid preparation tray as described in the preceding paragraphs that has a bottom wall provided with an upstanding food support structure and a catch basin for catching liquids associated with the food.

Another object of the invention is to provide a food preparation tray of the character described in the preceding paragraph in which the food supporting structure tends to secure the food in position within the tray.

Another object of the invention is to provide a food preparation tray as described in the preceding paragraphs that further includes at least one pour channel for conveniently pouring liquid from the catch basin.

Another object of the invention is to provide a preparation tray and food preparation tray assembly of the character described in the preceding paragraphs that is easy to use and one that can be economically produced in large quantities.

DETAILED DESCRIPTION OF THE INVENTION

Figure 1:
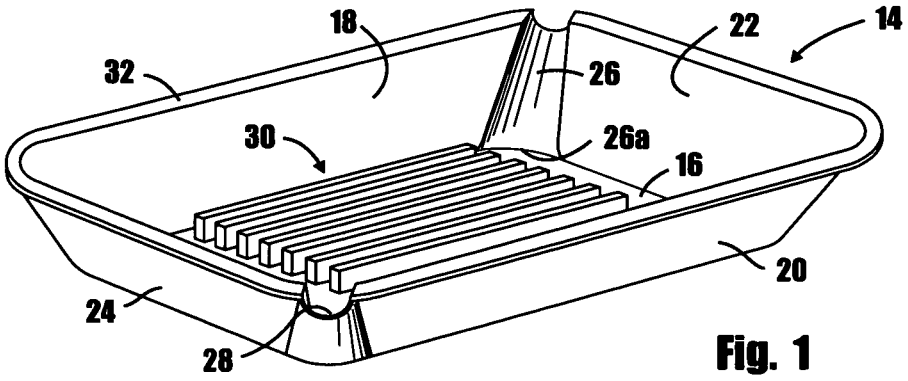
FIG. 1 is a generally perspective view of one form of preparation tray of the present invention.
Figure 2:
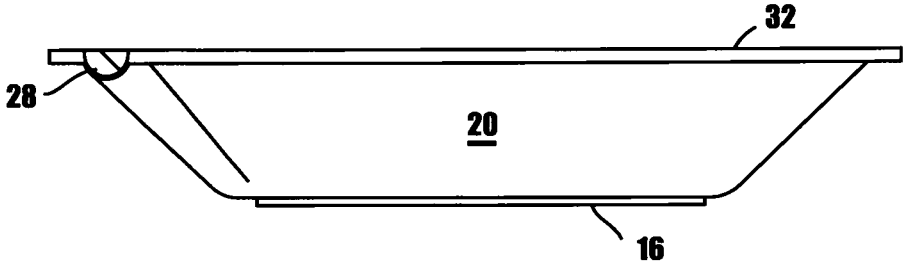
FIG. 2 is a side view thereof.
Figure 3:
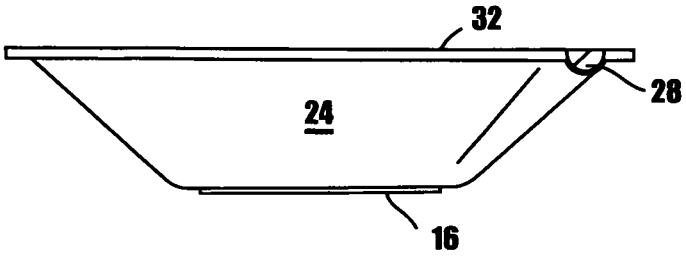
FIG. 3 is an end view thereof.
Figure 4:
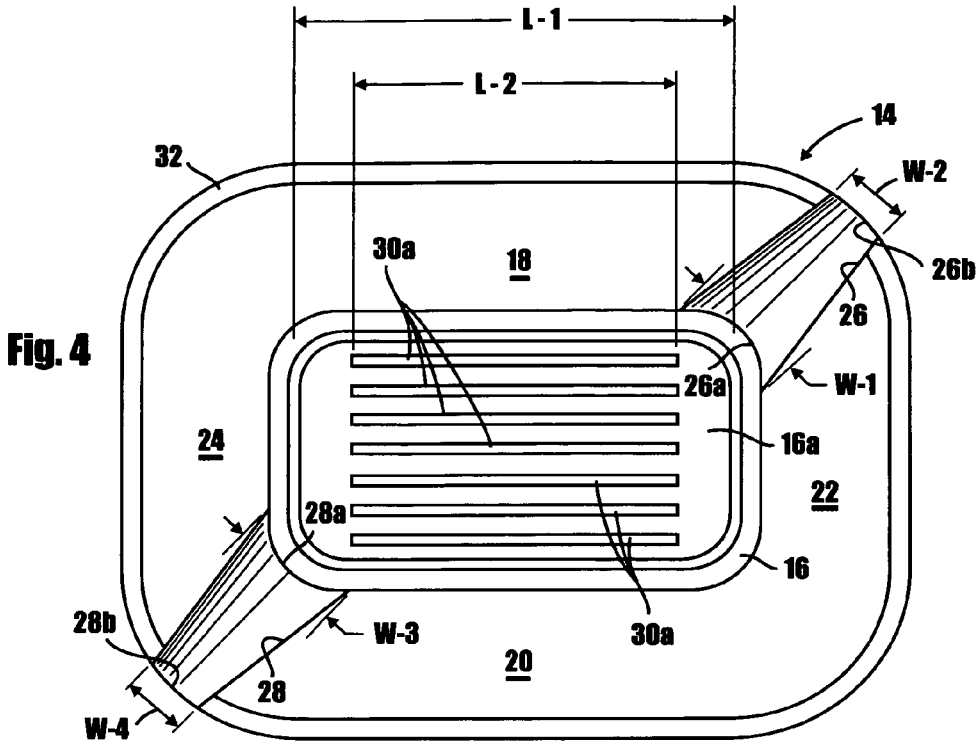
FIG. 4 is a top plan view thereof.
Figure 5:
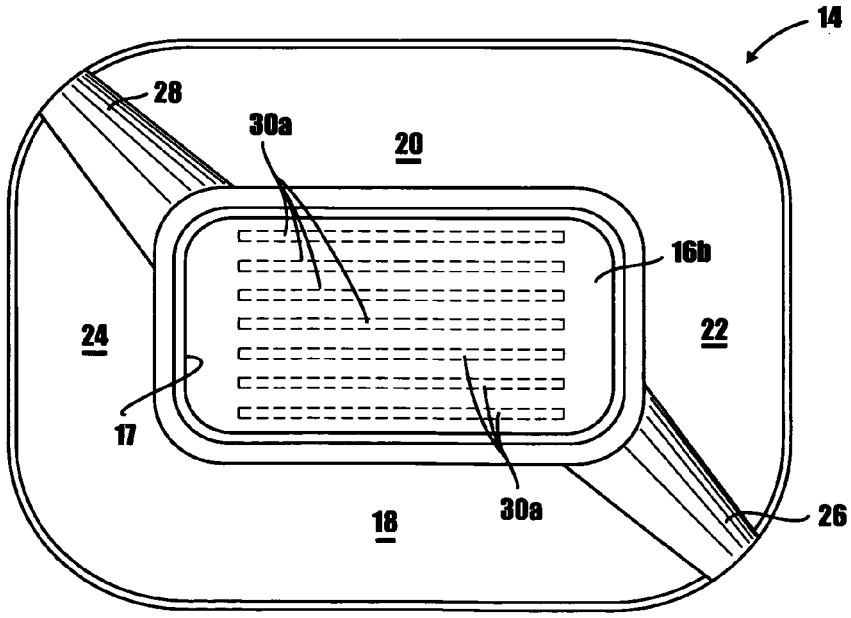
FIG. 5 is a bottom plan view thereof.

Referring to the drawings and particularly to FIGS. 1 through 4, one form of the food preparation tray of the invention for supporting food items therein is there shown and generally designated by the numeral 14. Tray 14 here comprises a bottom wall 16 having a top surface 16*a* and a bottom surface 16*b*. As illustrated in FIG. 5 of the drawings bottom surface 16*b* includes a recessed portion 17.

Connected to bottom wall 16 and smoothly transitioning therefrom are first and second angularly upwardly extending first and second transversely spaced apart side walls 18 and 20. Also connected to bottom wall 16 and smoothly transitioning therefrom are angularly upwardly extending first and longitudinally spaced apart end walls 22 and 24. Disposed between first side wall 18 and said first end wall 22 is a first angularly upwardly extending, tapered pour channel 26 that is generally "C" shaped in cross-section. As best seen by referring to FIGS. 1 and 4 of the drawings, pour channel 26 has an inlet 26*a* of a first width "W-1" that is in communication with bottom wall 16 and an outlet 26*b* of a second lesser width "W-2". Similarly, disposed between second sidewall 20 and second end wall 24 is a second angularly upwardly extending, tapered pour channel 28 that is generally "C" shaped in cross-section. Pour channel 28 has an inlet 28*a* of a first width "W-3" that is in communication with bottom wall 16 and an outlet 28*b* of a second lesser width "W-4". These pour channels, the purpose of which will presently be described, form an important aspect of the present invention Also forming an important aspect of the invention is a food support structure 30 that is connected to and extends upwardly from the upper surface 16*a* of bottom wall 16 for supporting food articles within the preparation tray. While the support structure 30 can be of various configurations, it is here provided in the form of a plurality of transversely spaced apart, longitudinally extending, generally parallel support members 30*a*. As indicated in FIG. 4 of the drawings, bottom wall 16 has a first length "L-1", while support members 36*a* are of a second length "L-2" less than first length "L-1".

In the preferred form of the invention, bottom wall 16, first and second angularly upwardly extending first and second transversely spaced apart side walls 18 and 20 and longitudinally spaced apart end walls 22 and 24, which terminate in a rim 32 are integrally formed from a rigid, microwavable material, such as a moldable plastic.

In using the apparatus of the invention, a food article such as, by way of example, a vegetable or a portion of meat is placed on the longitudinally extending generally parallel support members 30*a*. Because the preparation tray is constructed from a microwavable material, the tray along with the food article can safely be placed in a microwave for cooking or warming. Support members 30*a* are constructed and arranged to securely position and support the food article so that it can easily be cut as may be required. Similarly, the support members 30*a* are strategically spaced apart so that any liquids emanating from the food article will flow downwardly between the support members and onto the top surface 16*a* of the bottom wall for collection. By lifting and appropriately tilting the preparation tray, these collected liquids can be conveniently poured from the preparation tray through either of the pour channels 26 or 28. After use, the preparation tray can be conveniently washed either by hand or in a dishwasher.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A food preparation tray for supporting food items therein comprising:

(a) a bottom wall having a top surface and a bottom surface;

(b) first and second transversely spaced apart side walls connected to said bottom wall and extending angularly upwardly there from;

(c) first and second longitudinally spaced apart end walls connected to said bottom wall and extending angularly upwardly there from;

(d) a first angularly upwardly extending tapered pour channel formed between said first side wall and said first end wall, said first angularly upwardly extending tapered pour channel being generally "C" shaped in cross-section and having an inlet of a first width in communication with said bottom wall and an outlet of a second lesser width;

(e) a second angularly upwardly extending tapered pour channel formed between said second side wall and said second end wall, said second angularly upwardly extending tapered pour channel being generally "C" shaped in cross-section and having an inlet of a first width in communication with said bottom wall and an outlet of a second lesser width; and (f) a food support structure connected to and extending upwardly from said top surface of said bottom wall for supporting food articles within said preparation tray, said food support structure comprising a plurality of transversely spaced apart, longitudinally extending, generally parallel support members.

2. The food preparation tray as defined in claim 1 in which said bottom surface of said bottom wall includes a recessed portion.

3. The food preparation tray as defined in claim 1 in which said bottom wall, said first and second transversely spaced apart side walls, said first and second longitudinally spaced apart end walls, said first and second angularly upwardly extending pour channels and said generally parallel support members are integrally formed from a rigid, microwavable material.

4. The food preparation tray as defined in claim 1 in which said bottom wall has a first length and in which said generally parallel support members are of a second length less than said first length.

* * * * *